US007549740B2

(12) United States Patent
Yokoyama et al.

(10) Patent No.: US 7,549,740 B2
(45) Date of Patent: Jun. 23, 2009

(54) IMAGE RECORDING APPARATUS

(75) Inventors: Takeshi Yokoyama, Hachioji (JP); Takeo Arai, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 370 days.

(21) Appl. No.: 11/064,502

(22) Filed: Feb. 24, 2005

(65) Prior Publication Data

US 2005/0212855 A1 Sep. 29, 2005

(30) Foreign Application Priority Data

Mar. 26, 2004 (JP) ..... 2004-092893
Mar. 26, 2004 (JP) ..... 2004-092918
Sep. 9, 2004 (JP) ..... 2004-262348

(51) Int. Cl.
*B41J 2/01* (2006.01)

(52) U.S. Cl. ..... 347/102; 347/101

(58) Field of Classification Search ..... 347/102, 347/101, 100, 95, 96
See application file for complete search history.

(56) References Cited

U.S. PATENT DOCUMENTS

2003/0011670 A1* 1/2003 Shirakawa ..... 347/102
2003/0016269 A1* 1/2003 Sekiya ..... 347/102
2005/0062822 A1* 3/2005 Suzuki et al. ..... 347/102
2005/0212855 A1* 9/2005 Yokoyama et al. ..... 347/45

FOREIGN PATENT DOCUMENTS

JP 60-132767 7/1985
JP 2003-165208 6/2003

* cited by examiner

*Primary Examiner*—Manish S Shah
(74) *Attorney, Agent, or Firm*—Finnegan, Henderson, Farabow, Garrett & Dunner, L.L.P.

(57) ABSTRACT

An image recording apparatus includes: an inkjet recording head and a ultraviolet irradiating device, in which an image is fixed by irradiating ultraviolet rays after an ultraviolet rays curable ink is discharged onto an recording medium, and a protector which has a shape that a plurality of boards are arranged in a reticular pattern is provided on the irradiating aperture of the ultraviolet irradiating device.

26 Claims, 10 Drawing Sheets

IMAGE RECORDING APPARATUS

BACKGROUND

1. Field of the Invention

The present invention relates to an image recording apparatus, especially a recording apparatus using a photo curable ink which is cured by photo irradiation.

2. Description of Related Art

In an image recording apparatus in which a small ink droplet is discharged from a recording head and landed onto an recording medium which is placed to face with the recording head so that an image is recorded. There are problems such as drag and blur of ink due to uncuring and unfixing of ink when an image is recorded onto a recording medium having poor absorbability of ink.

In order to solve the above problems, a method to perform a suitable recording and fixing of an image is known, where photo curable ink containing a photo initiator sensitive to light such as ultraviolet is used and light is irradiated to the ink landed on the recording medium by a light irradiating device.

In curing and fixing ink, sensitivity of photo curable ink, timing of light irradiation, wavelength and intensity of the light and the like are factors which especially affect to image quality. Problems such as dot diameter and blur become more prominent as time goes by after landing of the ink. Thus, it is preferable the time interval between ink discharge and light irradiation is as short as possible.

For example, JP Tokukaisho 60-132767A discloses an inkjet printer provided with a curing and fixing member of landed ink, which is an ultraviolet irradiation lamp having sufficient length to irradiate approximately overall width of an recording medium which is installed fixedly on a side where the recording medium is ejected with regard to an inkjet recording head, and also discloses an inkjet printer of a serial print type in which an inkjet recording head moves in a width direction of the recording head, and an ultraviolet lamp is provided on at least one side of the recording head.

Generally, a light irradiating device using a high pressure mercury lamp as a light source is provided with a cooling device which cools the light irradiation lamp as a measure for heat. In order to prevent a problem that air flow generated by blowing of the cooling device interferes landing of ink discharged from a recording head, silica glass is provided at light irradiation aperture of the light irradiating device so that air flow toward the recording head is eliminated.

JP Tokukai 2003-165208A mentions a measure for heat of an ultraviolet irradiation lamp, and discloses an inkjet recording apparatus provided with an inkjet recording head, a cover of the ultraviolet irradiation lamp and an exhaust duct.

However, In the case that a jam of a recording medium occurs, for example, between a recording medium supporting section and a light irradiating device when a carriage on which the light irradiating device and a recording head are mounted moves for image scanning, a contamination or breakage may occur in case the carriage is very close to the recording medium. In such case, a recording medium may be fused and adheres to silica glass due to heat of the light irradiating device and the uncured ink landed on the recording medium adhere to the silica glass. Furthermore, the recording medium contacting with the light irradiating device may take fire due to heat of the light irradiating device.

On the other hand, for example, it is possible to use a low pressure mercury lamp in which a cooling device is not essentially required for the light irradiating device, in stead of the high pressure mercury lamp. In this case, the silica glass may not be provided to the irradiation surface of the light irradiating device. Therefore, surface of the light irradiation lamp may be contaminated with uncured ink or the light irradiation lamp is broken by contact of the recording medium, due to the jam occurred between the recording medium and the light irradiating device.

Due to the ink adhered to the light irradiating lamp or the silica glass or a flaw formed by the contact caused by the jam interrupts the light irradiated from the lamp so that light irradiation is not sufficiently irradiated to the ink landed on the recording medium. Thus, suitable curing and fixing of the ink is inhibited. Further, in the case a light irradiation lamp having high heating value such as a high pressure mercury lamp is used, it is necessary to prohibit a fire of the recording medium from the viewpoint of safety aspect.

SUMMARY

The object of the present invention is to provide an image recording apparatus which can form a clear image safely, wherein a protector is provided to the apparatus, which protects a light irradiation lamp or a silica glass from contamination caused by recording medium or uncured ink adhering thereto due to heat of the light irradiating device and breakage caused by the recording medium contacting therewith when the light irradiation lamp and silica glass moves in a scanning direction for recording an image and a jam occurs, thus sufficient photo irradiation to the ink landed on the recording medium is ensured so that the ink cures and is fixed suitably and the light irradiating device is prevented from directly contacting with the recording medium.

According to the first aspect of the invention, an image recording apparatus comprises:

a recording medium supporting section which supports a recording medium;

a recording head which discharges a photo curable ink that is cured by photo irradiation;

a light irradiating device which irradiates the photo irradiation to the photo curable ink on the recording medium, and includes a light source; and a protector which is provided between the recording medium supporting section and the light irradiating device, wherein the protector includes a partition element and a plurality of slits made by the partition element.

According to the second aspect of the invention, an image recording apparatus comprises:

a recording medium supporting section which supports a recording medium;

a recording head which discharges a photo curable ink that is cured by photo irradiation;

a light irradiating device which irradiates the photo irradiation to the photo curable ink on the recording medium, and includes a light source; and protector which is provided between the recording medium supporting section and the light irradiating device, wherein the protector of the image recording apparatus satisfies the following inequality, $$0.3 \leqq C/D < 1.0$$

where C represents a first conversion ratio of the photo curable ink in case the photo curable ink is irradiated by a first cumulative illumination intensity through the protector, and D represents a second conversion ratio of the photo curable ink in case the photo curable ink is irradiated by a second cumulative illumination intensity without the protector.

BRIEF DESCRIPTION OF THE DRAWINGS

The present invention will become more fully understood from the detailed description given hereinbelow and the appended drawings, and thus are not intended as a definition of the limits of the present invention, and wherein;

FIG. 13A shows a state that the ink spreads moderately and FIG. 13B shows a state that the ink cures with keeping small diameter.

DETAILED DESCRIPTION

Hereinafter concrete embodiments of the present invention are explained with reference to the drawings. However, the scope of the invention is not limited to the illustrated embodiments.

Figure 1:
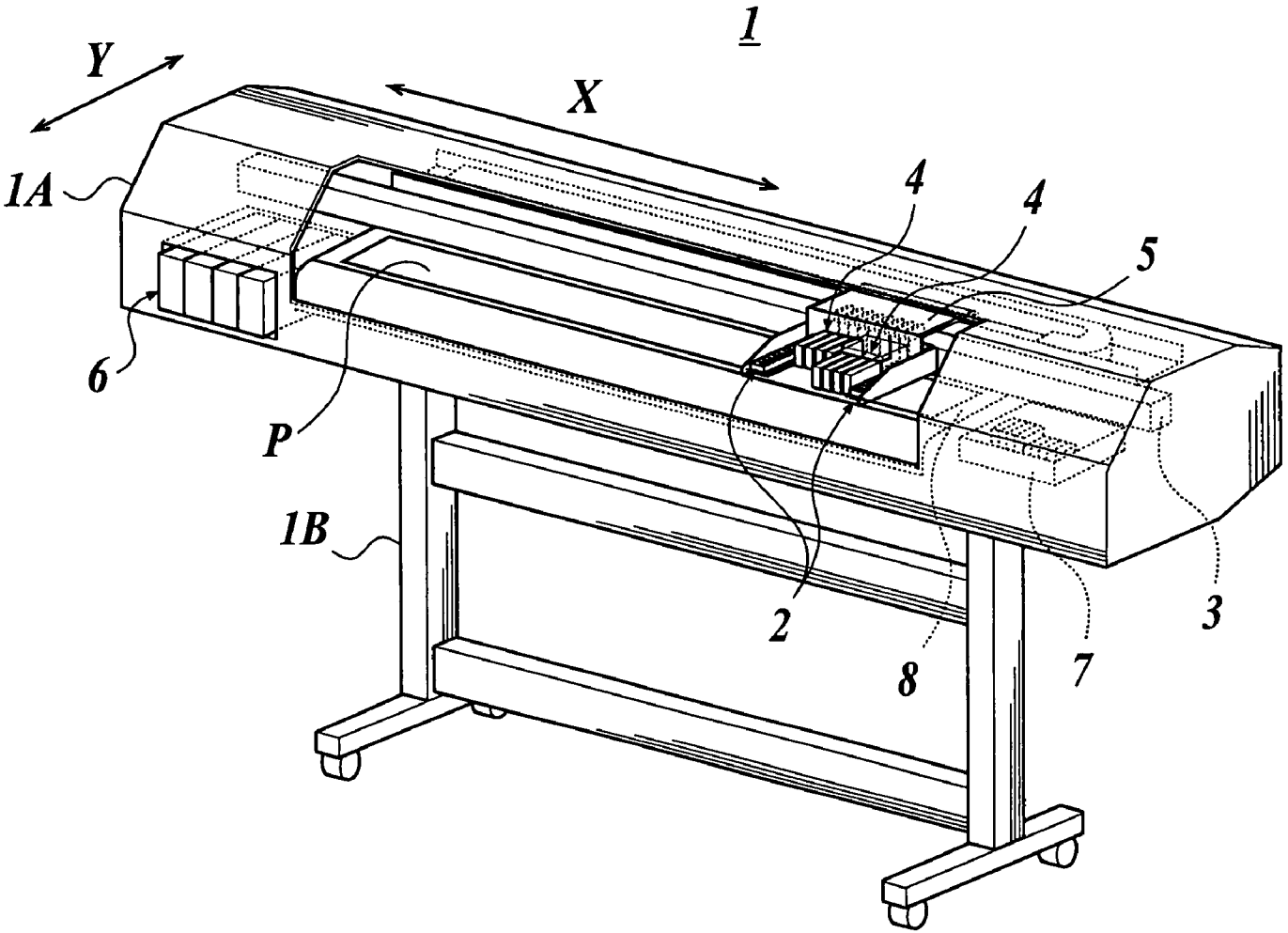
FIG. 1 is a perspective view showing a constitution of main parts of the inkjet printer which is one of the embodiment to which the present invention is applied.

FIG. 1 is a perspective view showing a constitution of main parts in which an image recording apparatus of the present invention is applied to an inkjet printer 1. The inkjet printer of the present embodiment is an inkjet printer of a serial head type, and comprises a printer main body 1A and a supporter 1B for supporting the printer main body 1A.

A rod type guide rail 3 is provided to interior of the printer main body 1A, and the guide rail 3 supports a carriage 5. The carriage 5 reciprocates in a main scanning direction X, which is width direction of a recording medium P, along with the guide rail 3 by a carriage actuator (not shown).

A recording head 4 which discharges inks of yellow (Y), magenta (M), cyan (C) and black (K) to the recording medium P is mounted on the carriage 5. Further, the inkjet printer 1 comprises an ink tank 6 to store the ink.

The recording head 4 comprises a plurality of nozzles (not shown) which discharges ink. And the nozzles are arranged in a sub scanning direction Y.

Here, the ink used in the present embodiment is explained. When cures the ink, a polymerizable compound contained in the ink is polymerized. In the present embodiment, the ink contains active energy ray curable compound as the polymerizable compound, and the ink is a ultraviolet rays curable ink in which the active energy to initiate the polymerization thereof is ultraviolet rays.

The ultraviolet rays curable ink is classified broadly into radical curable ink containing radical polymerizable compound as the polymerizable compound and cationic curable ink containing cationic polymerizable compound as the polymerizable compound. Either ink can be used as the ink applied to the present embodiment. Further, hybrid type ink in which the radical curable ink and cationic curable ink are combined each other can be used as the ink applied to the present embodiment.

However, the cationic curable ink incuring low or no inhibition of the polymerization reaction thereof caused by oxygen has better functionality and versatility. Thus, the cationic curable ink is used in the present embodiment. Concretely, the cationic curable ink of the present embodiment is a mixture containing at least the cationic polymerizable compounds such as an oxetane compound, an epoxy compound and a vinyl ether compound, a photo cationic initiator and a colorant, and the ink has a property to cure by the above ultraviolet rays irradiation.

A light irradiating device 2 is provided on the both sides of the recording head 4 of the carriage 5 in the main scanning direction X, where the ink discharged from the nozzles to the recording medium P cures by light irradiation. In the present embodiment, the light irradiating device is the ultraviolet irradiating device 2 for irradiating ultraviolet ray, since the ultraviolet curable ink is used as described above. However, the present invention is not limited thereto.

Figure 2:
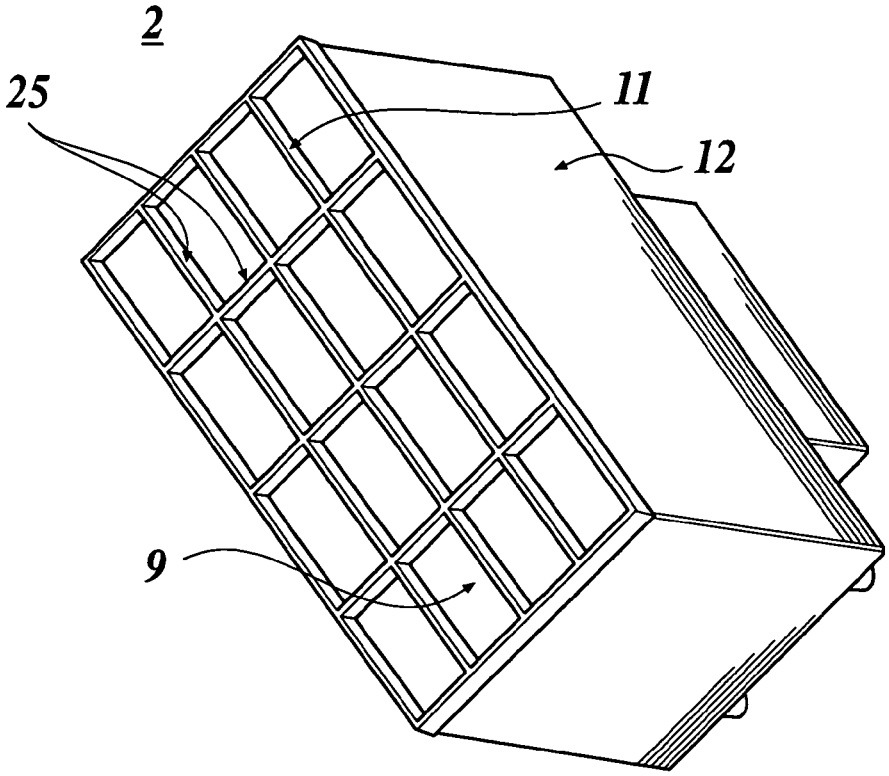
FIG. 2 is a perspective view showing a constitution of main parts of the ultraviolet irradiating device which is one of the present embodiment with which a protector is provided.
Figure 3:
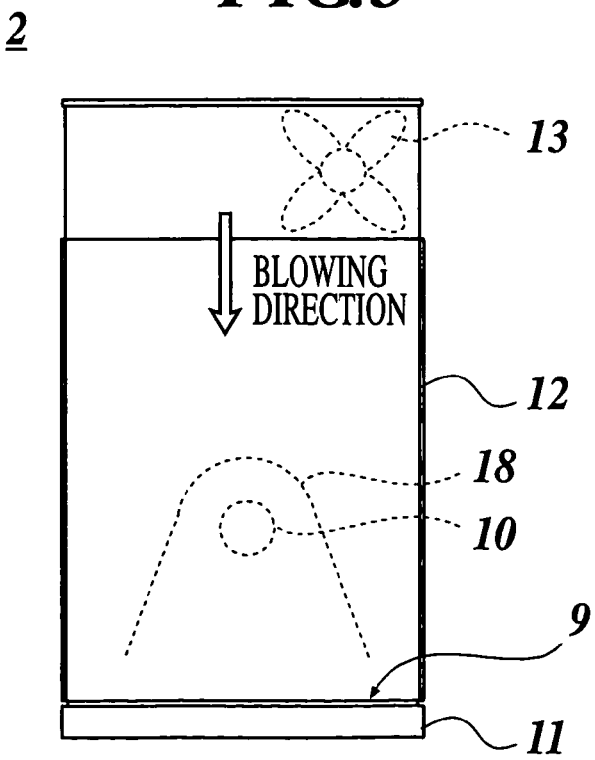
FIG. 3 is a side view of the ultraviolet irradiating device of FIG. 2.

Next, the ultraviolet irradiating device 2 is explained in detail with reference to FIGS. 2 and 3. This ultraviolet irradiating device 2 is an example where a high pressure mercury lamp is used as a light source. This ultraviolet irradiating device 2 comprises a housing 12 of box shape in which the undersurface thereof facing with the recording medium P is open. A light source 10 is placed inside the housing.

A reflection plate 18 reflecting ultraviolet rays irradiated from the light source 10 toward the recording medium is provided around the light source 10. A fan 13 is housed in the upper side of the housing 12. Interior of the housing 12 can be cooled by driving the fan 13. A silica glass 9 being capable of transmitting ultraviolet rays is provided on the surface of the housing 12 facing with the recording medium P. A protector 11 is attached to the ultraviolet irradiating device 2 so that the protector 11 covers the silica glass 9.

The silica glass provided on the irradiating aperture of the housing can reliably prevent the jammed recording medium or uncured ink thereon from directly contacting with the light source or the like. When the light source is high temperature, interior of the housing may be air-cooled with fan or the like. The silica glass provided on the irradiation aperture can prevent the air flow from flowing below the recording head and affecting to landing of the ink discharged from the recording head.

By doing so, the protector can moves suitably in conjunction with the movement of the ultraviolet irradiating device. Thus, the protector can effectively demonstrate the function to protect the ultraviolet irradiating device. Further, since the ultraviolet irradiating device supports the protector, a device to support and move the protector is not required so that the apparatus can be made to be more compact.

The present embodiment shows an example in which the ultraviolet irradiating device 2 comprises the housing 12 and the protector 11 is provided on the surface of the housing 12 facing with the recording medium P. However, the present invention is not limited thereto. The protector can be placed between the recording medium P supported by the recording medium mounting section and the light source 10 or the ultraviolet irradiating device 2, as long as the protector 11 does not interrupt the ultraviolet rays so as to prevent curing of the ink and the protector has a function to prohibit physical contact and/or adhesion of ink to the light source 10 or the ultraviolet irradiating device 2.

The protector 11 is formed by interlocking a plurality of boards 25 of long plates with each other in a reticular pattern, and is made of a material having high ultraviolet rays reflectance such as aluminum with mirror finished surface. By using aluminum and the like having high ultraviolet rays reflectance, the protector itself does not reduce ultraviolet rays irradiated from the light source so that the ultraviolet rays is sufficiently irradiated to the ink landed on the recording medium. Especially, when a high pressure mercury lamp or the like is used, deformation of the protector 11 is prohibited as a measure to heat.

Further, since the protector is formed in a reticular pattern, it is durable for an external impact. Thus, when a jam occurs between the ultraviolet irradiating device and the recording medium, the protector is durable for the jam and protects the ultraviolet irradiating device.

Figure 4:
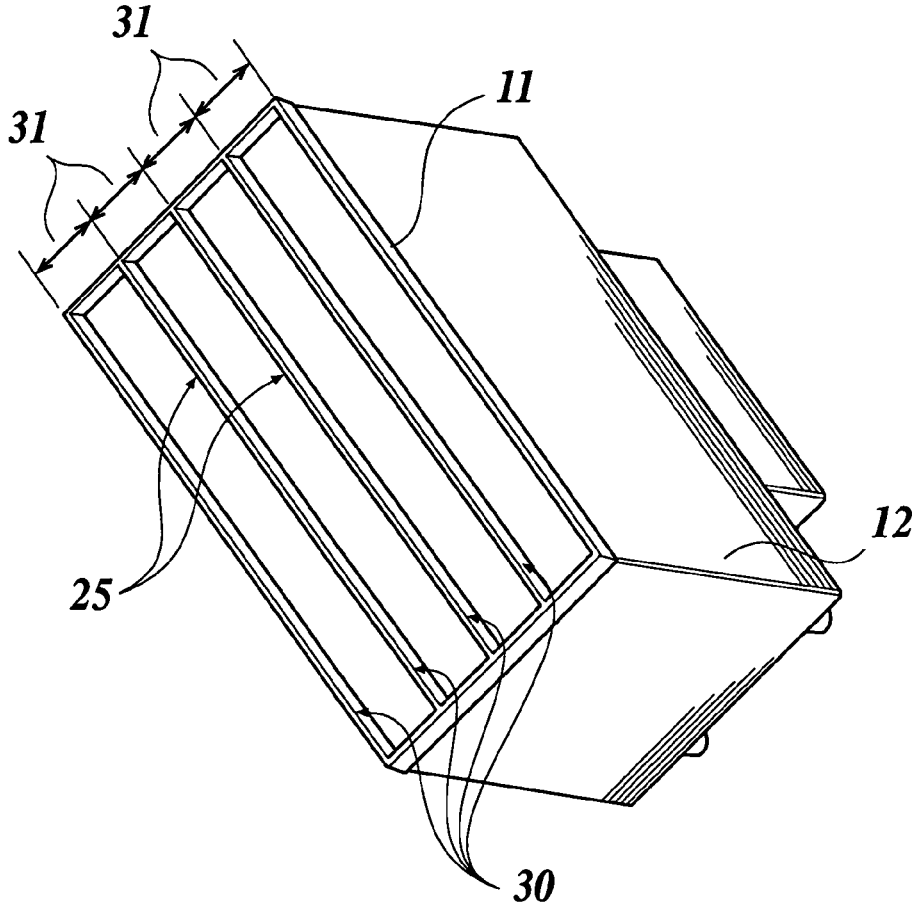
FIG. 4 is a perspective view showing a constitution of main parts of the ultraviolet irradiating device which is one of the present embodiment with which a partition element is provided.

FIG. 4 is a perspective view showing another embodiment of the protector in the ultraviolet irradiating device 2. As shown in FIG. 4, the protector 11 may comprise a partition element 30 formed by the board 25 so that a plurality of slits 31 are formed by the partition element.

That is, the present embodiment shows an example of the protector 11 in which the partition has a reticular pattern. However, the shape is not limited to a reticular pattern but can be honeycomb structure, slit, concentric ring structure or the like, as long as the protector 11 does not interrupt the ultraviolet rays which lets the ink cure and the protector has a function to prohibit physical contact and/or adhesion of ink to the light source 10 or the ultraviolet irradiating device 2.

When these structures are placed with regard to the ultraviolet irradiating device 2, they do not keep the heat generated by the ultraviolet irradiating device 2 since they all have air permeability.

In the case ink or the like may adhere to the protector 11 so that the irradiation of ultraviolet rays is reduced, it is preferable that the protector 11 is detachably provided on the ultraviolet irradiating device 2.

Since the protector is detachable, it is possible to exchange only the protector when it is broken by a jam. Further, the protector can be exchanged, when ink or the like adheres to the protector so that ultraviolet ray irradiation decreases.

The protector 11 is not limited to metal such as aluminum, as long as it has high ultraviolet rays reflectance so that it ensures the ultraviolet rays from the light source 10 gives sufficient irradiation to the ink landed on the recording head 4 for its curing and fixing. For example, it can be a cold mirror in which a film metal compound mainly containing aluminum is deposited onto a glass surface. Further, methods of plating, depositing or sputtering a reflection material having high ultraviolet rays reflectance onto other metal or a resin can be given.

Figure 5:
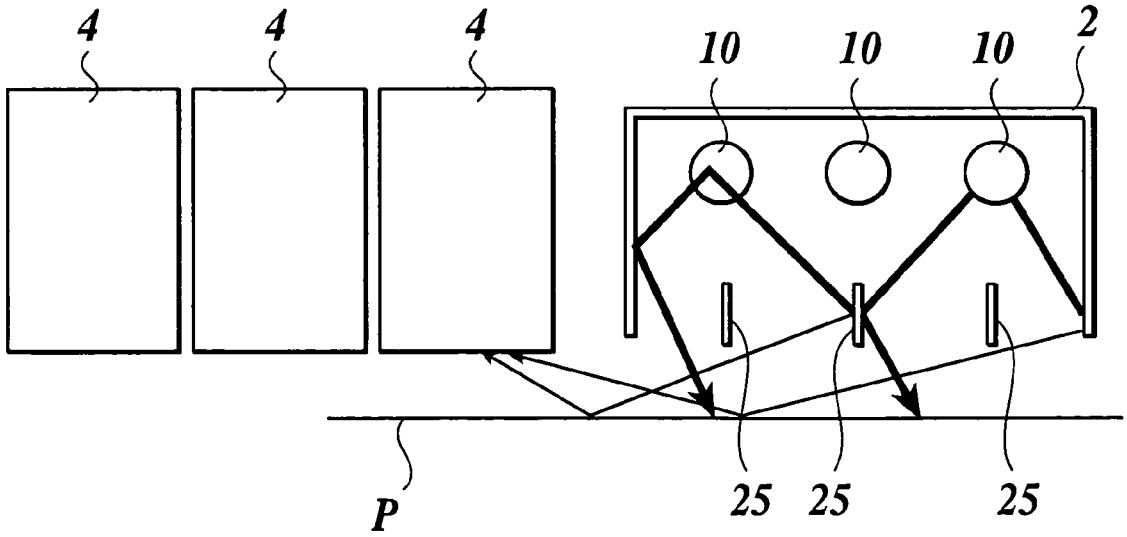
FIG. 5 is an explanatory drawing showing reflection of ultraviolet rays of the ultraviolet irradiating device of the present embodiment.

The face of the board 25 facing with the recording head 4 is preferably coated with a ultraviolet rays absorbent, so that the ultraviolet rays reflectance thereof is allowed to be lower than that of the face whose backside is faces with the recording medium, as shown in FIG. 5. Note that FIG. 5 shows the board in which the protector 11 is attached to the ultraviolet irradiating device 21 using an after-mentioned low pressure mercury lamp as the light source (see FIG. 7).

As for the ultraviolet rays absorbent, it is preferable to use that a material containing inorganic materials such as carbon black and ultra fine particles of titanium oxide, zinc oxide and iron oxide, and organic materials such as a benzotriazol compound or an aromatic compound, since it has high ultraviolet rays absorbance.

As for the method to forming the ultraviolet absorbing section on the face of the board 25 facing with the recording head 4, a method to treat the surface thereof with various metal oxidation treatment such as black alumite treatment, a method of plating treatment, deposition or sputtering treatment, and the like can be given. Further, it can be coated with various ultraviolet rays absorbents.

As for the light source for irradiating ultraviolet ray other than the above, hot cathode germicidal lamp, a cool cathode germicidal lamp, a low pressure mercury lamp, an electrodeless lamp, an excimer lamp, a metal-halide lamp, a xenon lamp, and LED can be applied.

A part of moving range of the carriage 5 is a recording range for recording images to the recording medium P. A platen 8 supporting the recording medium P from the non-recording side thereof is placed below the carriage 5 in the recording range.

A maintenance unit 7 for cleaning the recording nozzle of the recording head 4 is provided at the one of outer side of the recording range, which is within the moving range of the carriage 5. In the inkjet printer of the present embodiment, the carriage 5 moves to a predetermined position of the maintenance unit 7 and is cleaned, when predetermined times of image recordings are performed.

The present embodiment shows an example in which the recording head 4 is mounted on the carriage 5 and reciprocates in the main scanning direction X which is a width direction of the recording medium P. However, the present invention is not limited to this sample. The recording head may extend in the width direction of the recording medium P.

The present embodiment shows an example in which the recording medium P is carried in the sub scanning direction Y with regard to the recording head 4. However, the present invention is not limited thereto, and the apparatus further may comprise a relative moving section to move the recording medium P and the recording head relatively each other, in which the relative moving section is controlled by a controller.

For example, the above moving section to move the recording medium and the ultraviolet rays irradiating device relatively can be a driving unit to move a carrying roller carrying the recording medium in a carrying direction or the ultraviolet irradiating device in a main scanning direction. Further, when the ultraviolet irradiating device moves with regard to the fixed recording medium, the above moving section is a driving unit of the ultraviolet irradiating device. Since a jam of the recording medium occurs at a position where the ultraviolet irradiating device and the recording medium move relatively, the effect of the invention that occurrence of jam is prevented is effectively demonstrated in the image recording apparatus comprising such moving section.

Further, the present embodiment shows an example in which the ink discharged from the recording head 4 is directly landed onto the recording medium P. However, the present invention is not limited thereto. The ink discharged from the recording head 4 may be once supported by the supporter such as an intermediate transfer member, and subsequently the ink is transferred from the supporter to the recording medium P, so that the ink is landed on the recording medium P.

The present embodiment shows an example in which the ultraviolet irradiating device 2 is mounted on the carriage 5 and reciprocates in the main scanning direction X which is width direction of the recording medium P. However the present invention is not limited to this sample. The recording head may extend in the width direction of the recording medium P.

The present embodiment shows an example in which the recording medium P is carried in the sub scanning direction Y with respect to the ultraviolet irradiating device 2. However, the present invention is not limited thereto, and further may comprise a relative moving section to move the recording medium P and the ultraviolet irradiating device 2 relatively and the relative moving section is controlled by a controller.

Next, operation of the present embodiment is explained.

When certain image information is send to the inkjet printer, the recording medium P is carried intermittently on the platen 8 in the sub scanning direction Y with the non-recording side thereof supported by the platen 8.

Once a recording medium carrying system stops, the carriage 5 works to reciprocate directly over the recording medium P in the main scanning direction X. Being along with the above, the recording head 4 and the ultraviolet irradiating device 2 provided on the carriage 5 also reciprocate directly over the recording medium P as they follow the carriage 5. The ink of desired color is discharged from the nozzle of the recording head 4 toward the recording medium P, and ultraviolet rays is irradiated from the ultraviolet irradiating device 2. Thus, an image is formed.

Figure 6:
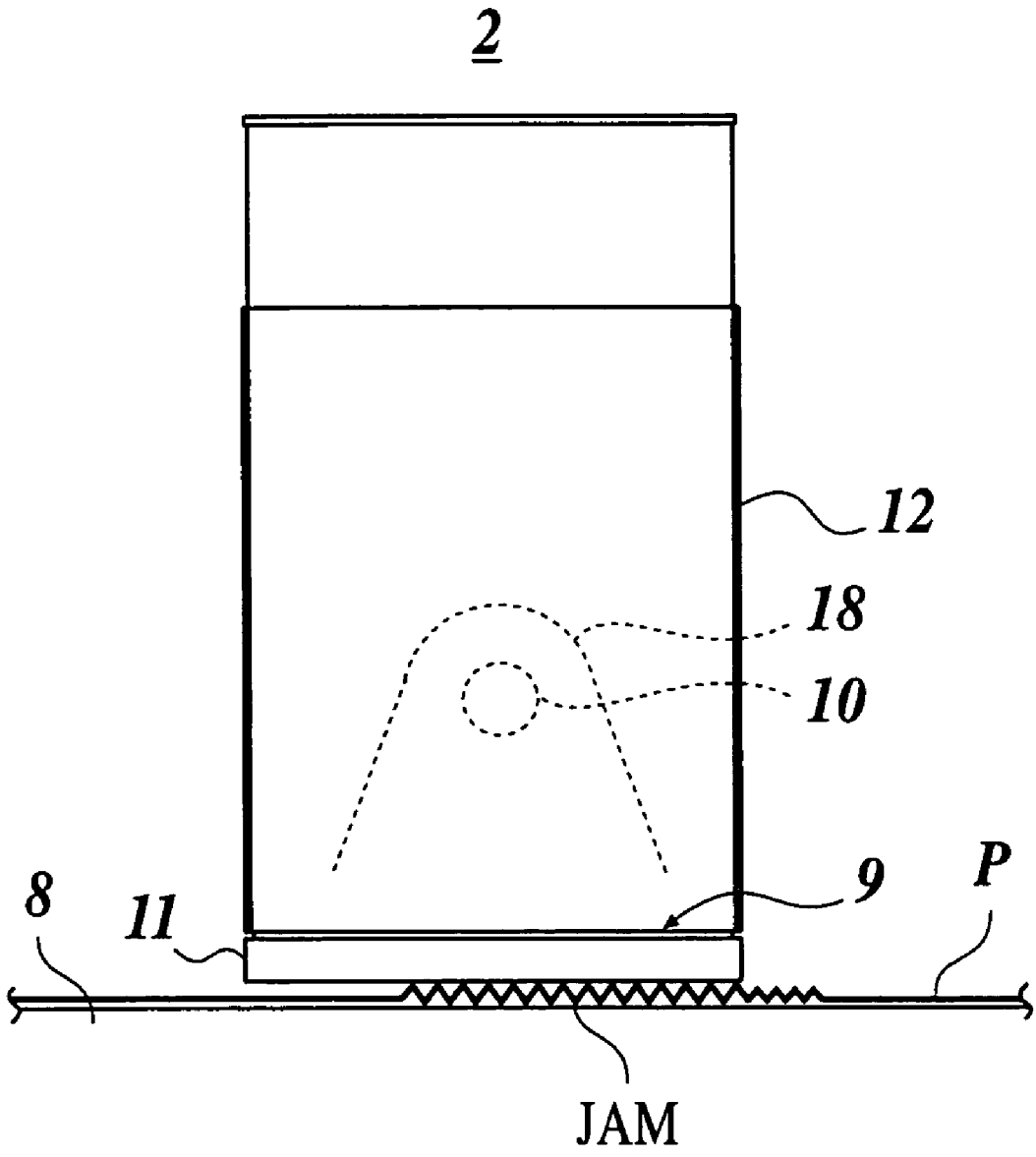
FIG. 6 is a schematic view which explains a jam occurred below the protector.

In the present embodiment, the protector 11 is provided to the ultraviolet irradiating device 2. Therefore, in the case that a jam such as a carrying trouble and a clog (see FIG. 6) occurs between the ultraviolet irradiating device 2 and the platen 8, it is possible to prevent the recording medium P from contacting directly with the ultraviolet irradiating device 2 or entering into it. Further, the protector is formed in a reticular pattern. Therefore, the light intensity of the ultraviolet rays irradiated from the ultraviolet irradiating device 2 is ensured at a certain level or more so that the ink discharged onto the recording medium P is cured certainly.

As described above, the present embodiment is successful in protecting the irradiating aperture of the ultraviolet irradiating device 2 reliably, irradiating ultraviolet rays sufficient to cure the ink discharged on the recording medium P, and performing a suitable image forming for a long time period, because the protector 11 prevent the recording medium P from directly contacting with the ultraviolet irradiating device 2 and entering into it when a jam occurs between the ultraviolet irradiating device 2 and the recording medium P.

Figure 7:
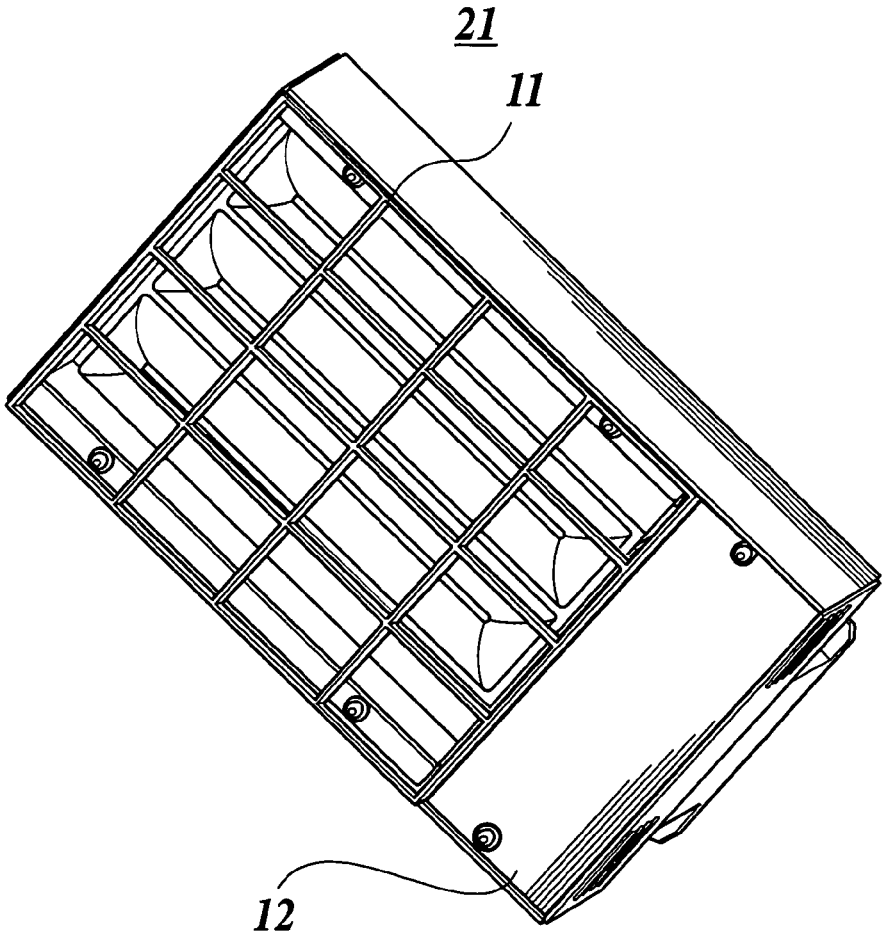
FIG. 7 is a perspective view showing a constitution of main parts of the ultraviolet irradiating device to which another embodiment of the protector is provided.
Figure 8:
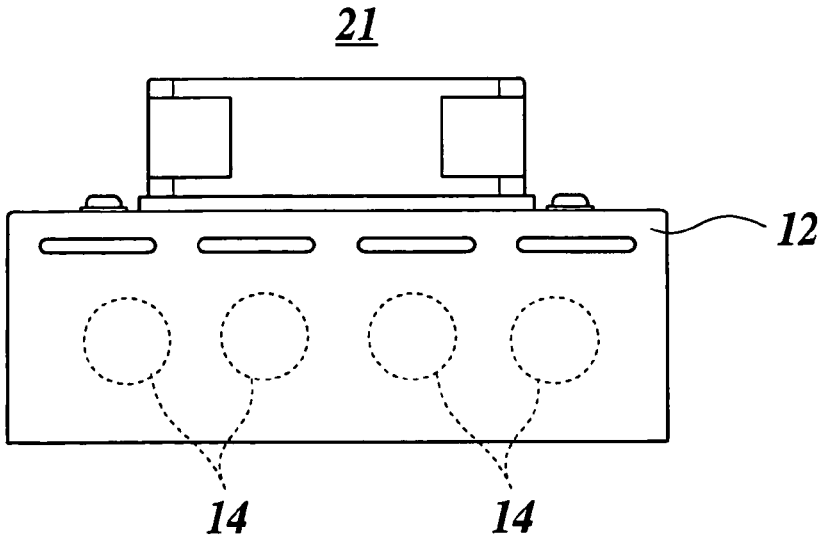
FIG. 8 is a side view of the ultraviolet irradiating device of FIG. 5.

FIGS. 7 and 8 show the ultraviolet irradiating device 21 which is another embodiment of the invention where a low pressure mercury lamp is used as the light source in the ultraviolet irradiating device 2, and it has approximately similar constitution with the above-described ultraviolet irradiating device 2 except the silica glass 9 and fan 13 are not provided.

Also in this embodiment, a protector 11 formed by interlocking a plurality of boards of long plates with each other in a reticular pattern is attached on the surface of a housing 12 of the ultraviolet irradiating device 21, facing with the recording medium P.

This protector is also made of a material having high ultraviolet rays reflectance such as aluminum with mirror-finished surface. However, when a low pressure mercury lamp is used as the light source, it is not essential that the measure to heat such for a high pressure mercury lamp be taken into account. Thus, any materials which fulfill the requirements of ultraviolet rays reflectance and durability can be used.

The present embodiment is also successful in protecting the irradiating aperture of the ultraviolet irradiating device 21 reliably, protecting a irradiated surface of the ink discharged onto the recording medium P, irradiating ultraviolet rays sufficient to cure the ink discharged onto the recording medium P, and performing a suitable image forming for a long time period, because the protector 11 prevent the recording medium from directly contacting with the ultraviolet irradiating device 21 and entering into it when a jam occurs between the ultraviolet irradiating device 21 and the recording medium P.

Figure 9A:
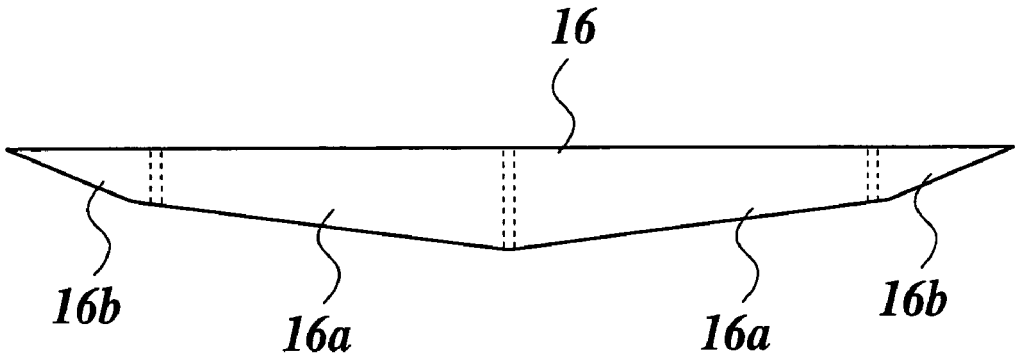
FIG. 9B is a perspective view showing a constitution of main parts of the protector of the present embodiment and FIG. 9A is a side view thereof.
Figure 9B:
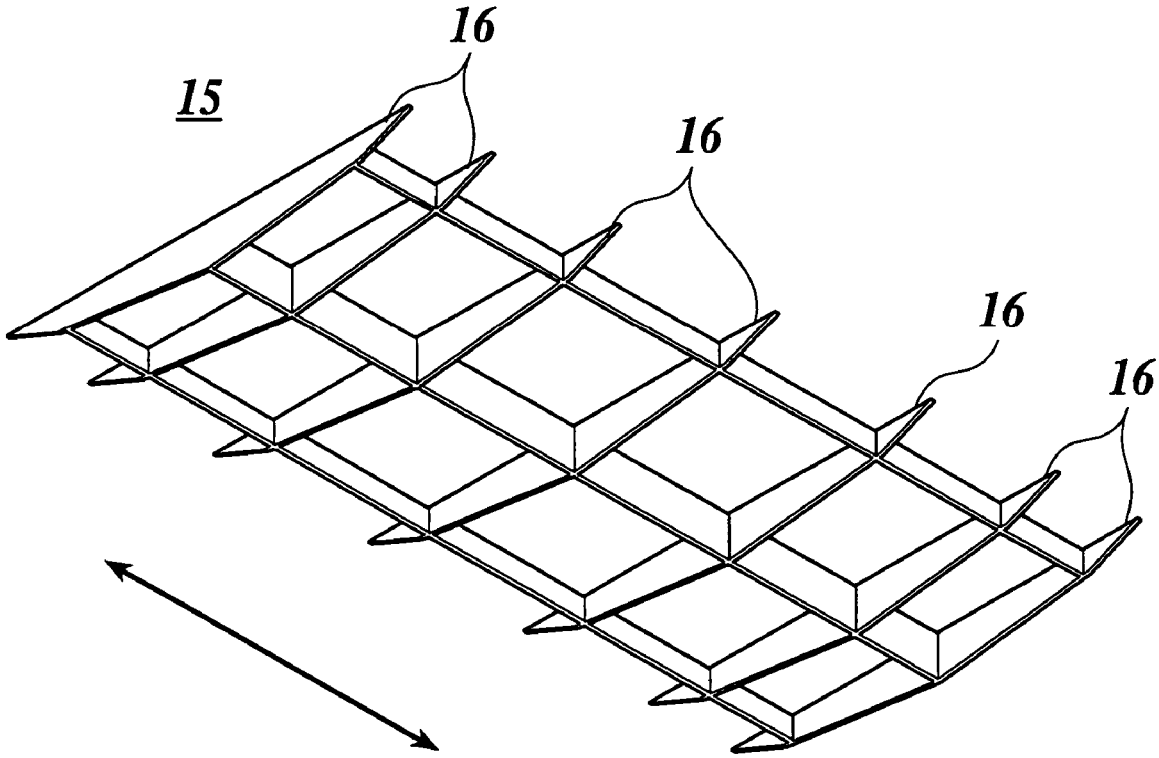

FIGS. 9A and 9B shows another embodiment of the protector 11, and FIG. 9A is a side view of a protector 15 observing in the main scanning direction and FIG. 9B is an overall perspective view of the protector 15.

The protector 15 has a shape in which a plurality of board 16 interlock with each other in a reticular pattern. The board 16 parallel to the main scanning direction X has a shape in which the center part of the lower surface thereof projects the highest toward the recording medium P and the board is chamfered (16*a*, 16*b*) so that the height of the board gets lower toward the both sides thereof.

A jam between the ultraviolet irradiating device and recording medium occurs especially at the supporter 15 in the main scanning direction X. Thus, by chamfering the ends of the board 16 provided parallel to the main scanning direction X so that the ends are lower than the center part, it becomes possible to reduce or prevent that the supporter 15 itself causes the jam.

Concretely, when the carriage 5 with the ultraviolet irradiating device 2 moves to a sagged portion of the recording medium P, the board 16 of the supporter 15 chamfered to be low height can guide the recording medium P while removing the sag thereof. Thus, it can reduce occurrence of the jam and prevent the recording medium P from directly contacting with the ultraviolet irradiating device 2.

Further, the center part of the board 16 is formed to be higher than the ends 16*a* and 16*b*. Thus, the mechanical strength of the supporter 15 is ensured, even when the jam occurs.

Figure 10A:
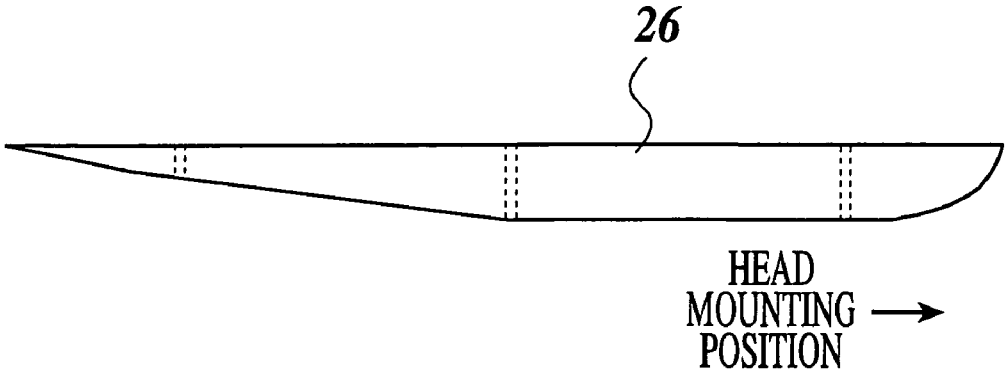
FIG. 10A is a side view thereof.
Figure 10B:
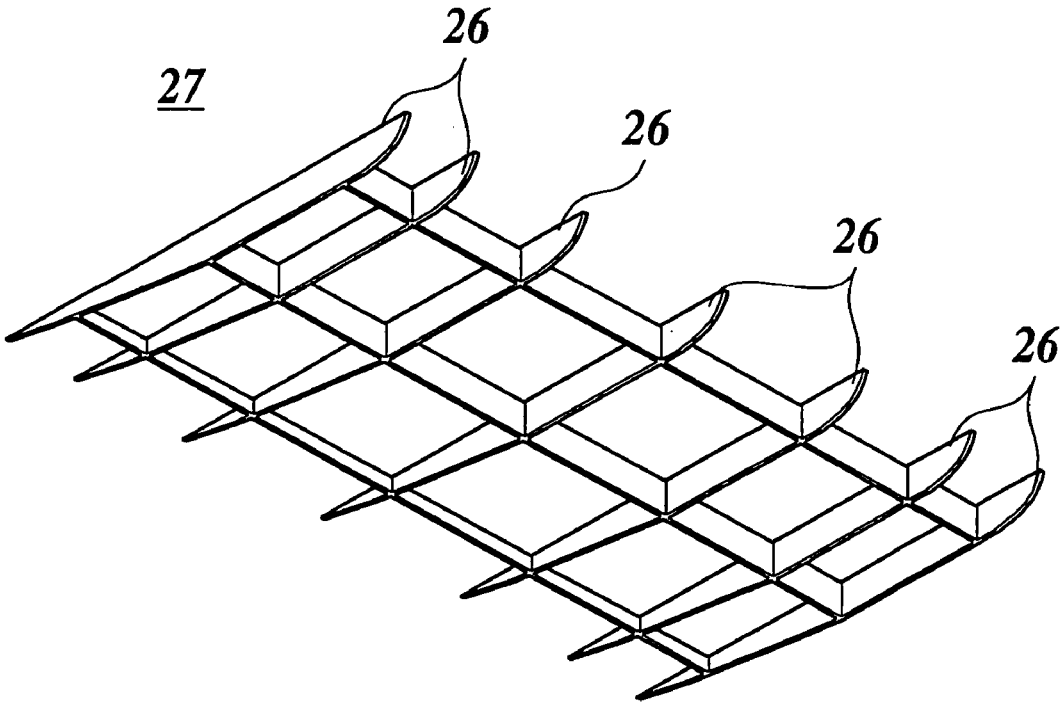
FIG. 10B is a perspective view showing a constitution of main parts of the protector which is a modified example of the protector in the present embodiment.

FIGS. 10A and 10B show a modified example of the supporter 15, and the basic constitution thereof is equivalent to the supporter 15 described in FIGS. 9A and 9B. Thus, only the difference is explained and the explanation for the other same parts is omitted. The same reference numerals are rendered to the same parts.

FIG. 10A is a side view of a protector 27 observing from the main scanning direction, and FIG. 10B is an overall perspective view thereof 27.

A board 26 of the protector 27 parallel to the main scanning direction X has a shape in which the board 26 is chamfered so that the lower face thereof gets lower from the center part toward the side end neighboring the recording head 4 opposite to another side end. The side end of the board 26 neighboring the recording head 4 is chamfered to be a curve.

When the carriage 5 with the recording head 4 and ultraviolet irradiating device 2 move in the main scanning direction X, a jam occurs mainly at the ends in the main scanning direction. By forming the board 26 as described above, it can guide the recording medium P while removing the sag thereof. Thus, it can reduce occurrence of the jam and prevent the recording medium P from directly contacting with the ultraviolet irradiating device 2.

Further, since the side end of the board 26 neighboring the recording head 4 is a curve, a jam occurring while the protector 27 moves to the recoding head 4 side in the main scanning direction X can be prevented.

By chamfering the board 26, it is possible to ensure the mechanical strength of the protector 27, and to lower the overall height of the protector 27.

Here, the distance between the platen 8 which is a recording medium mounting base supporting the recording medium P from the non-recording side thereof and the protector provided with the ultraviolet irradiating device 2 is explained. It is important for reducing the occurrence of the jam that a first distance is larger than a second distance, where the first distance is a distance between an edge portion of the protector and the platen 8, and the second distance is a distance between another portion of the protector and the platen 8 with regard to moving direction of the ultraviolet irradiating device 2. The present invention is not limited to the embodiments exemplified in FIGS. 9A, 9B, 10A and 10B from the viewpoint described above.

Since the first distance is larger than the second distance, sag or the like of the recording medium caused by a jam is introduced from a portion of the protector locating moving direction side of the light irradiating device to a center part of the light irradiating device. Thus, it can prevent the recording medium from directly entering to or contacting with the light irradiating device. When the recording medium includes concavoconvex such as sag, the protector allows the recording medium to be flat while introducing the concavoconvex of the recording medium therebelow. Thus, by using such protector, occurrence of jam can be reduced more reliably.

Figure 11:
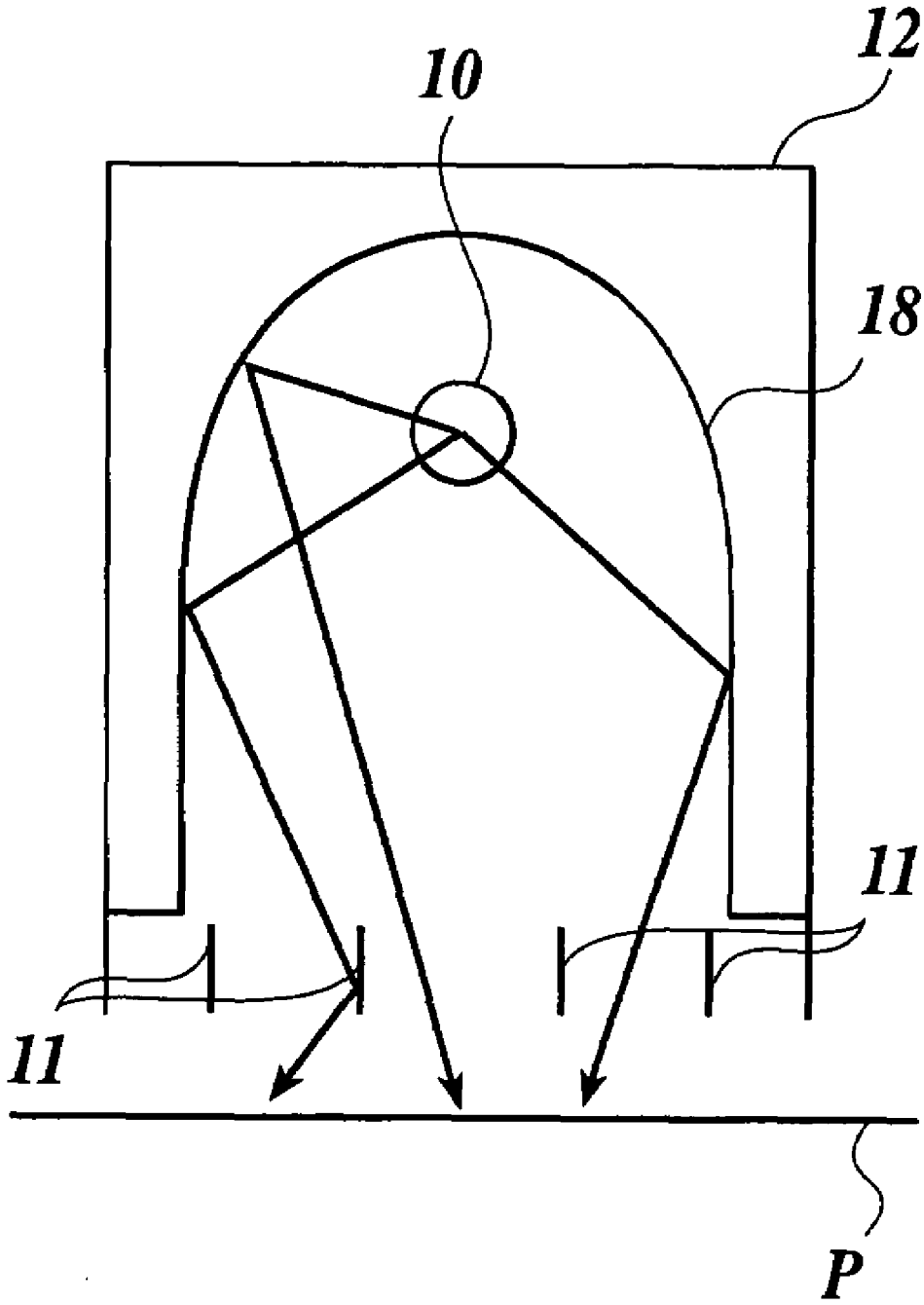
FIG. 11 is a sectional view of the ultraviolet irradiating device showing density and irradiation spectrum of ultraviolet rays in the present embodiment.
Figure 12:
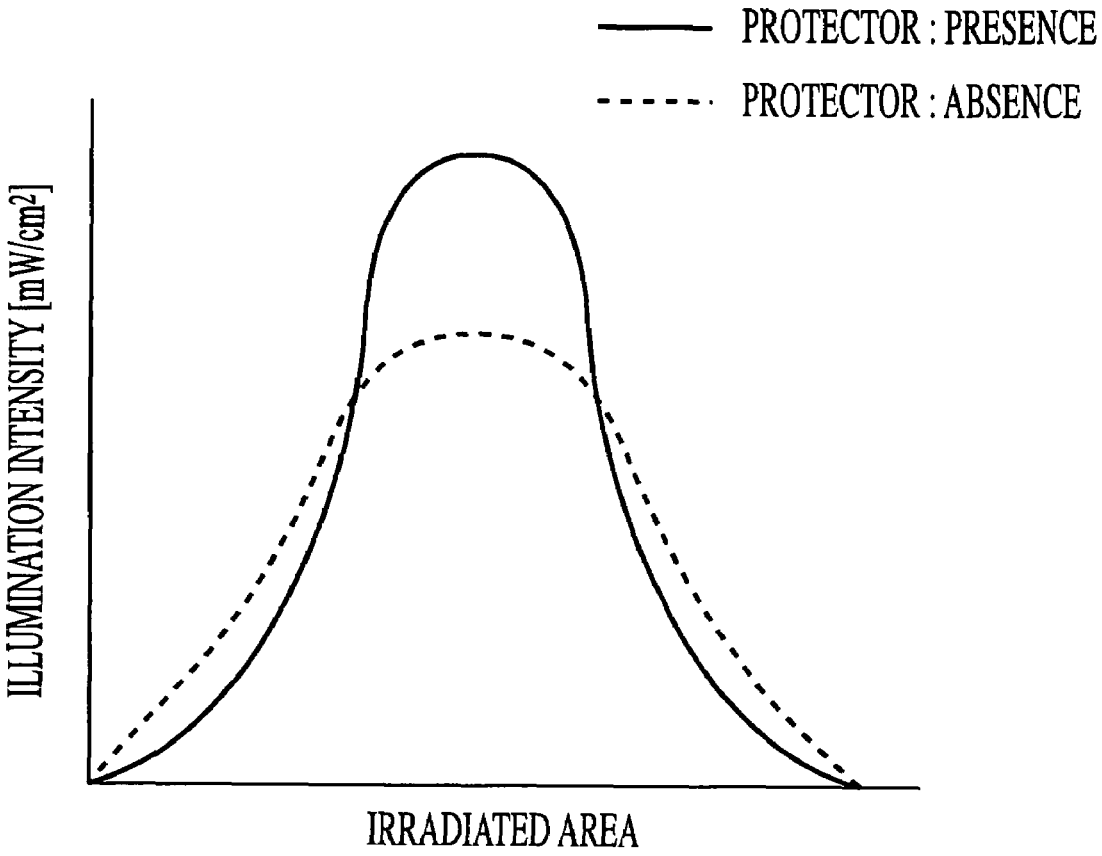
FIG. 12 is a graph showing cumulative illumination intensity of ultraviolet rays of the ultraviolet irradiating device in the present embodiment.

As shown in FIG. 11, when the protector 11 is provided between the light source 10 or the ultraviolet irradiating device 2 and the recording medium P supported by the platen 8, illumination intensity and irradiation spectrum vary. More concretely, decrease of peak illumination intensity or the like occurs as shown in FIG. 12.

Thus, it is preferable that the ratio of the cumulative illumination intensity where through protector 11 to the cumulative illumination intensity without the protector 11 fulfills the following inequality.

$$0.7 \leqq \text{cumulative illumination intensity through the protector 11/cumulative illumination intensity without the protector 11}$$

By doing so, the cumulative illumination intensity irradiated onto the recording medium is allowed to be in the above range, when the protector is provided. Thus, it becomes possible to irradiate sufficient light to the ink landed on the recording medium for the curing thereof, and to perform an image forming of high quality and high definition.

Here, the cumulative illumination intensity is obtained as follows.

[Ultraviolet Irradiation Device]

Light source:

High pressure mercury lamp having peak wavelength at 254 nm (nominal value in the catalogue)

Low pressure mercury lamp having peak wavelength at 254 nm (nominal value in the catalogue)

Metal halide lamp having peak wavelength at 365 nm (nominal value in the catalogue)

LED having peak wavelength at 365 nm (nominal value in the catalogue)

[Illumination Intensity Measuring Device]

Ultraviolet cumulative illumination intensity meter (made by Iwasaki Electric Co., Ltd.): UVPF-A1.

Light receiving element (made by Iwasaki Electric Co., Ltd.): PD-254 (measuring wavelength range: 240 to 280 nm)

PD-365 (measuring wavelength range: 300 to 390 nm)

Connected to ultraviolet cumulative illumination intensity meter

[Measuring Method]

A measurement is carried out with ultraviolet illumination intensity meter after emission of the light source of the ultraviolet irradiating device of the inkjet printer is stabilized, for example, after 10 to 15 minutes.

In normal image forming, the ink is discharged and ultraviolet rays is irradiated in a state that the recording medium is mounted on the recording medium mounting section. Therefore, in this measurement, the light receiving element is fixed in which the light receiving surface thereof and the recording medium are located on the same plane.

The light receiving element and the ultraviolet irradiating device are relatively moved in a normal image forming mode (referred to as a standard mode, normal mode and default mode, when there are a plurality of modes), and the amount of emitted light received in the moving is measured as the cumulative illumination intensity. In measuring the cumulative illumination intensity, it is not necessary to discharge ink.

When a line type head is used as the recording head of the inkjet printer, a cumulative illumination intensity while the recording medium relatively moves once in carrying direction for predetermined length is measured. When a serial type head in which the recording head is mounted on the carriage is used as the recording head, cumulative illumination intensity while the recording medium relatively moves once in the main scanning direction (X direction in the present embodiment) is measured.

The speed of any relative movement is optional. However, it is required that the relative movement is slower than the sampling rate of the light receiving element.

The position of the light receiving element is optional in any case.

As for the relative movement of the light receiving element and ultraviolet irradiating device, please refer to the explanation for the relative movement of the recoding medium P and ultraviolet irradiating device 2.

The measured cumulative illumination intensity is represented by a product of illumination intensity (illuminance) and illumination time, for example, 20 mJ/cm$^3$.

In the above measurement, the light receiving element of the illumination intensity meter is attached to the inkjet printer. However, when it is difficult, same result can be obtained in any condition equivalent to the above measurement condition in normal recording mode (the relative speed of the light receiving element and ultraviolet irradiating device and the distance between the light source and the light receiving surface are same as the above-described condition), such that the ultraviolet irradiating device is installed to other devices.

When the high pressure mercury lamp having peak wavelength at 254 nm (nominal value in the catalogue) is used as the light source 10, the light source emits light having an infrared spectrum across a wide range of 200 to 400 nm. Thus, the cumulative illumination intensity can be measured with two types of the light receiving elements whose measuring wavelength range are 240 nm to 280 nm and 300 nm to 390 nm respectively. Other than the above, it is possible to select a light receiving elements in combination so that spectral sensitivity of the ink used in the inkjet printer is within the above-described measurement range or peak wavelength of an optional light source is within the measurement wavelength range of the light receiving element.

When the light source has single peak wavelength, it should be appreciated that only one light receiving element having the measuring range including the peak wavelength is solely used for the measurement.

In any case, the light receiving element used for measuring illuminance is selected so that the measurement wavelength range thereof includes peak wavelength of the light source.

In order to prevent that ultraviolet rays is interrupted by providing the supporter 11 and it prevents the ink from curing, it is preferable that the relation between cumulative illumination intensity through the protector 11 and cumulative illumination intensity without the protector 11 fulfills the following inequality.

$$0.7 \leqq \text{cumulative illumination intensity through the protector 11/cumulative illumination intensity without the protector 11}$$

The reflectance of the surface facing with the head is preferably 50% or less at the peak wavelength of the light source (nominal value in the catalogue), and 20% or less is more preferable.

By doing so, the light source housed in the ultraviolet irradiating device is protected, and when ultraviolet rays is irradiated to the surface which is in a side where the recording head is located, the amount of the ultraviolet rays reflected toward the recording head decreases to not more than 50%. Thus, incidence of the ultraviolet rays to discharging aperture of the recording head is reduced, so that it becomes possible to prevent the clogging due to curing and fixing of ink at the discharging aperture of the recording head and to perform a suitable image recording for a long time period.

The reflectance of the surface opposite to the surface facing with the head is preferably 60% or more at the peak wavelength of the light source (nominal value in the catalogue), and 80% or more is more preferable.

By doing so, the light source housed in the ultraviolet irradiating device is protected and sufficient ultraviolet rays can be irradiated to the ink landed on the recording medium for its curing. Thus, it becomes possible to perform image recording at high quality.

[Measuring Method of Reflectance]

An integrating sphere of 60 mm is attached to the light receiving portion of a spectrophotometer U-3300 produced by Hitachi Corp., in which the measurement range of the sphere includes wavelength of the light source of the spectrophotometer.

Firstly, light intensity of a standard reflection plate which is a standard measuring object of the reflectance is measured. Spectoraton reflection standard (250 to 2500 nm) of nominal reflectance of 99% produced by Labsphere Corp., whose measurement range includes the wavelength of the light source of spectrophotometer is used as the standard reflection plate. It is preferable to use a brand-new standard reflection plate since reflectance of the measuring object may vary according to the surface condition of the plate.

Light transmits a prism so that the wavelength thereof is controlled, and the controlled light enters a sample placed inside the integrated sphere. The light reflected on the standard reflection plate is diffused inside the integrated sphere, and finally reaches the light receiving portion and is detected as light intensity.

Next, the standard reflection plate is replaced with the protector 11, and the same measurement is performed to the partition element of the protector 11.

Let the ratio of the light intensity obtained for the standard reflection plate to the light intensity obtained for the partition element of the protector 11 be the reflectance of the partition element of the protector 11 at its measured surface.

$$\text{Reflectance} = \text{light intensity of the partition element of the protector 11 at its measured surface/light intensity of standard reflection plate} \times 100\ (\%)$$

As shown in FIG. 5, the face of the board of the protector facing with the recording head is coated with the ultraviolet absorbent and the other face is made of aluminum having high ultraviolet rays reflectance. Thus, the reflection of the ultraviolet rays irradiated from the light source to the face of the board 25 facing with the recording head 4 can be reduced. As a result, the ultraviolet rays irradiated to the discharging aperture of the recording head 4 can be reduced. On the other hand, the ultraviolet rays irradiated to the other face is effectively reflected toward the recording medium. Thus, even in the case that a part of the ultraviolet rays irradiated from the light source is interrupted by the protector, the ultraviolet rays is effectively irradiated to the recording medium so that the ink discharged onto the recording medium P is certainly cured and fixed.

As described above, the present embodiment is successful in protecting the irradiating aperture of the ultraviolet irradiating device 2 reliably, irradiating ultraviolet rays sufficient to cure the ink discharged onto the recording medium, and performing a suitable image forming for a long time period, because the protector 11 prevent the recording medium from directly contacting with the ultraviolet irradiating device 2 and entering into it when a jam occurs between the ultraviolet irradiating device and the recording medium.

The first surface of the board 25 facing with the recording head is coated with the ultraviolet absorbent, so that the reflection of the ultraviolet rays irradiated from the light source to the face of the protector facing with the recording head 4 can be reduced. Thus, the ultraviolet rays irradiated to the discharging aperture of the recording head 4 can be reduced so that it can prevent the ink at the discharging face form curing. Thus it becomes possible to perform a suitable discharge for a long period.

The protector can be formed so that the pitch between the boards 25 gets narrower as it is closer to the recording head 4. By placing the boards as described above, the board interferes the ultraviolet rays irradiating in an large incident angle with respect to the recording medium P, so that a part of ultraviolet rays can be interrupted. Thus, it can prevent the ultraviolet rays from reflecting toward the recording head 4, and intensity of the light irradiating to the discharging aperture of the recording head can be reduced.

Also in the present embodiment, the surface of the board 25 facing with the recording head 4 is coated with the ultraviolet absorbent as same as the above embodiment. By doing so, the reflection of the ultraviolet rays irradiated from the light source to the face of the board 25 facing with the recording head 4 can be reduced. As a result, the ultraviolet rays irradiated to the discharging aperture of the recording head 4 can be reduced. On the other hand, the ultraviolet rays irradiated to the other face is effectively reflected toward the recording medium. Thus, even in the case that a part of the ultraviolet rays irradiated from the light source is interrupted with the protector, the ultraviolet rays is effectively irradiated to the recording medium so that the ink discharged onto the recording medium P is certainly cures and is fixed.

The protector 11 prevents the recording medium P from directly contacting with the ultraviolet irradiating device 21 and entering to it when a jam occurs between the ultraviolet irradiating device 21 and the recording medium P. Thus, the present embodiment is successful in protecting the irradiating aperture of the ultraviolet irradiating device 21 reliably, irradiating ultraviolet rays sufficient to cure the ink discharged onto the recording medium P, and performing a suitable image forming for a long time period.

Further, it is preferable that the supporter 11 is constituted so that the proportion of C with respect to D fulfills the following inequality, where D represents conversion ratio of the ink on the platen where ultraviolet rays is irradiated without the supporter 11 and C represents conversion ratio of the ink where ultraviolet is irradiated through the supporter 11.

$$0.3 \leqq C/D < 1.0$$

Here, the conversion ratio represents a value showing proportion of polymerization where the polymerization rate of ink is as 100 when the ink cures perfectly. The value can be obtained by, for example, analyzing an infrared spectrum. That is, a specific peak of the infrared spectrum varies according to the polymerization reaction, and difference of absorbance in between unreacted state and steady state where sufficient energy and time have been given (i.e. the maximum variation) is measured, and the conversion ratio is obtained as a ratio of absorbance variation at the predetermined timing to the maximum variation.

The conversion ratio can be obtained by measuring a change with time after giving a predetermined amount of light, in which an ultraviolet spectrometer being capable of performing real-time measurement such as, for example, NEXUS 470 made by Thermo Electron Corp. Here, "ink cures perfectly" represents a time point, for example, when variation of the absorbance is 0.1 or less for 10 seconds after the time point.

When the above-described supporter 11 is provided on the irradiating aperture of the ultraviolet irradiating device 2, amount of the ultraviolet rays which reaches the recording medium decreases since a part of the ultraviolet rays irradiated from the light source 10 is interrupted. Since polymerization rate of the cationic curable ink especially varies according to the amount of the irradiated ultraviolet ray, the conversion ratio of the ink depends on the amount of the irradiated ultraviolet ray.

As a result, the proportion of C with respect to D (hereinafter referred to as conversion ratio proportion C/D) fulfills the following inequality, where D represents conversion ratio of the ink on the platen (same as on the recording medium) where ultraviolet rays is irradiated without the supporter 11 and C represents conversion ratio of the ink where ultraviolet is irradiated through the supporter 11.

$$C/D < 1.0$$

The larger the degree of masking of the ultraviolet rays by the protector 11 is, the smaller value of the conversion ratio proportion C/D shows. Lower limit of the conversion ratio D to cure the ink to be a state practically usable is already determined. Therefore, when the degree of masking of the ultraviolet rays by the protector 11 is large, the amount of ultraviolet rays irradiated from the light source 10 is required to become increased (i.e. it is adjusted to be larger the conversion ratio D) in order to keep the amount of ultraviolet rays irradiated to the ink.

On the other hand, energy loss of the ultraviolet rays which has been interrupted by the supporter 11 is finally converted to heat energy, and it is accumulated below the light source in the ultraviolet irradiating device 2. As described above, when value of the conversion ratio proportion C/D gets low, i.e. degree of masking of the ultraviolet rays by the supporter 11 gets larger so as to be larger energy loss of the ultraviolet ray, the amount of ultraviolet rays emitted from the light source 10 have to be increased. Thus, the heat accumulated below the light source gets larger.

Figure 13A:
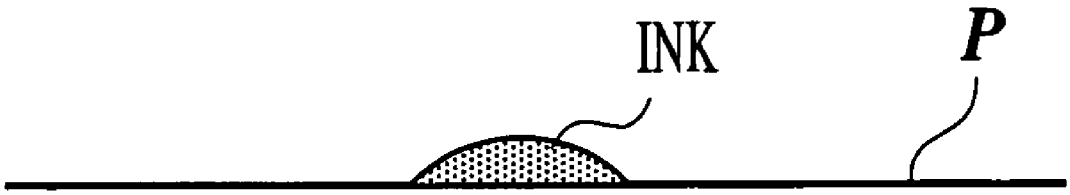
FIGS. 13A and 13B are views which explain spread of the ink on the recording medium, where
Figure 13B:
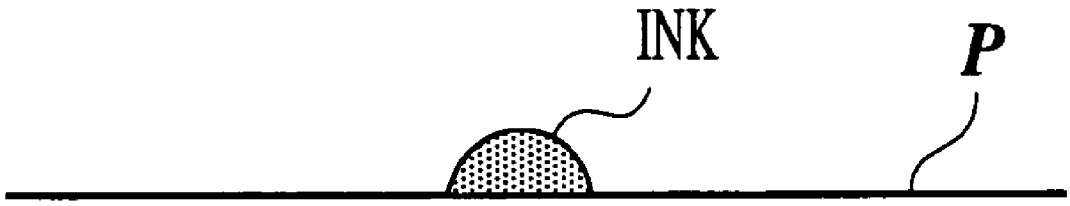

The ink landed on the recording medium begins to polymerize when ultraviolet rays is irradiated. In a state without heat, the polymerization requires a certain time till the polymerization is completed. Thus, the ink cures in a state of spreading moderately (see FIG. 13A). However, when heat is accumulated below the light source as described above, the curing is promoted to be faster due to heat. Thus, the ink cures in a state of small diameter before it spreads moderately on the recording medium (see FIG. 13B).

When the degree of masking of the ultraviolet rays by the protector 11 is high and the energy loss of the ultraviolet rays is too large (i.e. the conversion ratio proportion C/D is too small), extremely large amount of heat is accumulated below the light source and glossiness of the recorded image is lost. When the above problem is considered from the view point of image quality of the product, it can not ignore since there occurs a difference of glossiness in the recorded image between a product recorded at the start of the recoding when heat has not been accumulated yet and a product recorded in a state where heat is accumulated below the light source due to continuous recording.

As demonstrated in the following embodiment, such difference of glossiness due to heat can be reduced to be negligible from the viewpoint of quality control, when the conversion ratio proportion is 0.3 or more and more preferably 0.5 or more.

As described above, the image recording apparatus of the present embodiment is provided with the protector placed below the ultraviolet irradiating device. Thus, even when a jam occurs below the ultraviolet irradiating device, the protector effectively presses the jam toward the platen so that it effectively prevent the recording medium and the uncured ink thereon from contacting with the light source and silica glass of the ultraviolet irradiating device. Depending on the shape of the protector, the protector can allow concavoconvex of the recording medium entering below the protector to be flat, so that it can also prevent occurrence of a jam.

Further, it becomes possible to prevent that the recording medium is fused and adheres to the light source or silica glass due to heat of the light source of the ultraviolet irradiating device, the recording medium takes fire when the light source is high temperature, and the uncured ink on the recording medium adheres to the light source or silica glass and is burned.

On the other hand, when the protector is provided below the ultraviolet irradiating device, a part of the ultraviolet rays emitted from the light source is interrupted by the protector and the energy is finally accumulated below the light source as heat. The curing rate of the ink landed on the recording medium is promoted due to the heat so that glossiness of the image, which is created when the ink moderately spreads on the recoding medium, decreases.

However, decrease of the glossiness due to heat can be effectively prevented when the protector is constituted so that the proportion of C with respect to D (i.e. the conversion ration proportion C/D) fulfills the following inequalities, where D represents conversion ratio of the ink on the platen where ultraviolet rays is irradiated without the supporter 11 and C represents conversion ratio of the ink where ultraviolet is irradiated through the supporter 11.

$$0.3 \leqq C/D < 1.0$$

It is more preferable that the supporter is made to fulfill the following inequality, since it becomes possible to prevent such decrease of glossiness due to heat.

$$0.5 \leqq C/D < 1.0$$

EMBODIMENT

Hereinafter, the embodiment is explained. However, the present invention is not limited thereto.

<<Experimental Apparatus>>

The image recording apparatus used in the experiment is a serial head type inkjet printer shown in FIG. 1 performing a bi-directional image forming, and comprises ultraviolet irradiating devices at both upper and lower sides of moving direction of the carriage 5. A silica glass is provided on the irradiating aperture of the ultraviolet irradiating device, and a supporter is provided therebelow.

<<Preparation of Ink>>

Black ink of the following ink composition (where "%" designates mass %) was prepared according to the following procedure.

| | |
|---|---|
| Colorant : | |
| C.I pigment black-7 | 3.0% |
| Photo polymerizable compound: | |
| LDO (ATOFINA Corp. ) | 39.0% |
| OXT-221 (TOAGOSEI Co., Ltd.) | 30.0% |
| OXT-101 (TOAGOSEI Co., Ltd.) | 20.0% |
| Photoinitiator : | |
| UV16992 (Dow Chemical Corp., 50% solution of propioncarbonate) | 5.0% |
| Dispersant : | |
| PB822 (Ajinomoto Fine Techno Co., Inc.) | 3.0% |
| Total: | 100% |

Firstly, above-described amount of the dispersant and photo polymerizable compound were put into a stainless beaker and were stirred and mixed for 1 hour with heating on a hot plate of 65° C., so that they were dissolved. Next, above-described amount of the colorant was added the solution, the solution was put into a plastic container with 200 g of zirconia beads having 1 mm diameter, and the container was hermetically sealed. A dispersing treatment by a paint shaker was given to the solution for 2 hours. Next, the zirconia beads were removed and the photo polymerizable initiator and the like was added thereto. The solution was filtrated with a membrane filter of 0.8 μm to prevent clogging of the printer, so that the ink was prepared.

<<Measuring Method of Conversion Ratio>>

The unreacted ink was applied onto a thin aluminum plate to be about 10 μm thickness. Absorbance at a specific peak of the infrared spectrum of the ink (hereinafter referred to as an absorbance 1) was measured with an infrared spectrometer (NEXUS 470 (made by Thermo Electron Corp.) is used in the present embodiment).

Next, the aluminum plate on which the unreacted ink had been applied was attached on the surface of the platen of the inkjet printer. The carriage was scanned in a state that the supporter is provided to the ultraviolet irradiating device, so that ultraviolet rays was irradiated to the ink on the aluminum plate. As described above, the amount of the ultraviolet rays emitted from the light source was adjusted so that a predetermined amount of ultraviolet rays was irradiated to the ink in a state that the supporter was attached.

After the ultraviolet rays irradiation, the aluminum plate was taken out and the absorbance of the specific peak in the infrared spectrum of the ink is measured with the infrared spectrometer (hereinafter referred to as an absorbance 2).

Here, the specific peak of the infrared spectrum of the ink used in the measurement of the absorbance can be selected from any peaks with which the polymerization rate of the ink according to the ultraviolet irradiation can be measured. When the selected specific peak is related to a bond between monomers of the photo polymerizable compounds which is newly formed by the polymerization reaction caused by the ultraviolet rays irradiation, the absorbance 2 becomes larger than the absorbance 1. On the contrary, when the selected specific peak is related to the intramolecular structure of the monomer itself, which will be lost by the polymerization reaction, the absorbance 2 is smaller than the absorbance 1.

Next, the aluminum plate on which the unreacted ink had been applied was attached on the platen of the inkjet printer. The carriage was scanned in a state that the supporter was removed and the amount of the ultraviolet rays emitted from the light source of the ultraviolet irradiating device was not changed, so that ultraviolet rays was irradiated to the ink on the aluminum plate. After the ultraviolet rays irradiation, the absorbance was measured similarly (hereinafter referred to as an absorbance 3).

The conversion ratio proportion C/D was calculated from the absorbance 1 to absorbance 3 according to the following formula.

Conversion ratio proportion=(absorbance 2−absorbance 1)/(absorbance 3−absorbance 1)

Where, the absorbance 2 and absorbance 3 represent absorbance under an identical certain condition, and the absorbance 1 represents absorbance in which the polymerization does not proceed at all. When let absorbance X denote the absorbance in a state that the ink is completely cured, the following equalities are given.

Conversion ratio proportion=conversion ratio C in a state that the supporter is provided/conversion ratio D in a state that the supporter is not provided Conversion ratio C in a state that the supporter is provided=(absorbance 2−absorbance 1)/(absorbance X−absorbance 1)

Conversion ratio D in a state that the supporter is not provided=(absorbance 3−absorbance 1)/(absorbance X−absorbance 1)

Thus, the above formula is lead from these equalities.

<<Experiment>>

In the experiment, various kinds of supporter having different structures each other, which was attached under the silica glass of the ultraviolet irradiating device of the inkjet printer, were used, so that the conversion ratio proportion C/D was changed. The glossiness on the surface of the recording medium at the start of recording (a state that heat is not accumulated below the light source) and the glossiness on the surface of the recording medium after continuous recording for 20 minutes (a state that heat is accumulated below the light source) were compared with each other.

That is, four aluminum plates on which the unreacted ink had been applied were prepared for each protector. Ultraviolet rays was irradiated to two of them in a state that the protector is attached or removed respectively, and immediately they were taken out from the platen and the absorbencies thereof were measured. Here, the surface glossiness of the aluminum plate to which the ultraviolet rays was irradiated in a state that the protector was attached was measured to be the glossiness at the start of recording.

Further, the remaining two aluminum plates were attached onto the platen after the inkjet printer continuously performed recording for 20 minutes. Immediately after ultraviolet rays was irradiated to the plates in a state that the protector is attached or removed respectively, they were taken out from the platen and the absorbencies thereof were measured. Here, the surface glossiness of the aluminum plate to which the ultraviolet rays was irradiated in a state that the protector was attached was measured to be the glossiness after continuous recording for 20 minutes.

<<Measuring Method of Glossiness>>

The glossiness was measured with a glossiness meter (gloss checker IG-310 (made by Horiba Ltd.)) in which a ratio of incident light to reflected light is measured optically. When a difference of glossiness measured with this glossiness meter is 1 or less, the difference of glossiness between the two recoded images is merely recognized. When the measured difference is about 2, the difference is small. When the measured difference is about 3, the difference is recognized when they are set side by side, but the difference is merely recognized when they are observed separately. When the measured difference is 5 or more, the difference is recognized even when they are observed separately.

<<Estimation>>

With respect to the image at the start of recording and the image after continuous recording for 20 minutes, comparison of the glossiness by visual observation and difference of glossiness measured by the glossiness meter are shown in TABLE 1, in which various kinds of the protectors were used so that the conversion ratio proportion C/D was changed.

TABLE 1

| CONVERSION RATIO PROPORTION C/D | DIFFERENCE OF GLOSSINESS, VISUALLY OBSERVED | DIFFERENCE OF GLOSSINESS, MEASURED |
|---|---|---|
| 0.1 | D | 7 |
| 0.2 | D | 5 |
| 0.3 | C | 3 |
| 0.4 | B | 2 |
| 0.5 | A | 1 |
| 0.6 | A | 1 |

With respect to the difference of glossiness between the image at the start of recording and the image after continuous recording for 20 minutes, the result of visual observation is estimated according to the following criteria.

A: No difference is recognized.

B: Slight difference is recognized.

C: The difference is recognized when they are set side by side.

D: Lack of glossiness is recognized even when observed solely.

As shown in TABLE 1, in the case that the conversion ratio proportion is less than 0.3, the recorded image after continuous recording for 20 minutes lacks glossiness which is recognized even when observed solely. That is, when image recording is performed continuously, the image recording apparatus using such protector can record only an image with decreased glossiness. Thus, it is impossible to use the protector which gives the conversion ratio proportion C/D of less than 0.3.

On the other hand, when the protector which gives the conversion ratio proportion C/D of 0.3 or more is used, the obtained image has a quality required for the product. When the conversion ratio proportion C/D is 0.5 or more, it is more preferable. That is, when such protector is used, image quality (especially glossiness) merely decreases even when the image recording apparatus records image continuously.

The present embodiment is a case that the ink is the black ink (K). Since the component which cures by polymerization reaction among the ink composition is the photo polymerizable compound and the polymerization reaction is not related to the kind of the colorant, the result of the present embodiment can be applied to the other color inks. The same or similar results are obtained for the other photo polymerizable compounds other than that in the present embodiment and the radical polymerizable ink using a radical polymerizable compound.

The entire disclosure of Japanese Patent Application Nos. 2004-92893, 2004-92918 and 2004-262348 filed on Mar. 26, 2004, Mar. 26, 2004 and Sep. 9, 2004, respectively, including specification, claims, drawings and summary are incorporated herein by reference.

What is claimed is:

1. An image recording apparatus, comprising:

a recording medium supporting section which supports a recording medium;

a recording head which discharges a photo curable ink that is cured by photo irradiation;

a light irradiating device which irradiates the photo irradiation to the photo curable ink on the recording medium, and includes a light source; and a protector which is provided between the recording medium supporting section and the light irradiating device at the time of an image recording operation, wherein the protector includes a partition element and a plurality of slits made by the partition element, wherein the image recording apparatus satisfies the following inequality, $$0.7 \leqq A/B < 1.0$$

where A represents a first cumulative illumination intensity in case the first cumulative illumination intensity through the protector is measured on the recording medium supporting section, and B represents a second cumulative illumination intensity without the protector is measured on the recording medium supporting section.

2. The image recording apparatus of claim 1, wherein the protector is formed in a reticular pattern.

3. The image recording apparatus of claim 1, further comprising: a moving section which relatively moves at least one of the recording medium and the light irradiating device.

4. The image recording apparatus of claim 3, wherein a first distance is longer than a second distance, the first distance is a distance between a portion of the protector and the recording medium supporting section, the second distance is a distance between another portion of the protector and the recording medium supporting section with regard to a relative movement direction of the recording medium and the light irradiating device.

5. The image recording apparatus of claim 1, wherein the protector is provided on the light irradiating device.

6. The image recording apparatus of claim 1, wherein the protector is detachably provided on the light irradiating device.

7. The image recording apparatus of claim 1, wherein the photo irradiation is ultraviolet rays irradiation.

8. The image recording apparatus of claim 7, wherein the partition element includes a first surface and a second surface, the first surface is in a side where the recording head is located, and the second surface is in an opposite side to the first surface, a reflectance for the ultraviolet rays irradiation of the first surface is smaller than the that of the second surface.

9. The image recording apparatus of claim 7, wherein the partition element includes a surface, the surface is in a side where the recording head is located, a reflectance for the ultraviolet rays irradiation of the surface is not more than 50%.

10. The image recording apparatus of claim 7, wherein the partition element includes a surface, the surface is in an opposite side to where the recording head is located, a reflectance for the ultraviolet rays irradiation of the surface is not less than 60%.

11. An image recording apparatus, comprising:

a recording medium supporting section which supports a recording medium;

a recording head which discharges a photo curable ink that is cured by photo irradiation;

a light irradiating device which irradiates the photo irradiation to the photo curable ink on the recording medium, and includes a light source; and protector which is provided between the recording medium supporting section and the light irradiating device, wherein the protector of the image recording apparatus satisfies the following inequality, $$0.3 \cdot \leqq C/D < 1.0$$

where C represents a first conversion ratio of the photo curable ink in case the photo curable ink is irradiated by a first cumulative illumination intensity through the protector, and D represents a second conversion ratio of the photo curable ink in case the photo curable ink is irradiated by a second cumulative illumination intensity without the protector.

12. The image recording apparatus of claim 11, further comprising:

a moving section which relatively moves at least one of the recording medium and the light irradiating device.

13. The image recording apparatus of claim 12, wherein a first distance is longer than a second distance, the first distance is a distance between a portion of the protector and the recording medium supporting section, the second distance is a distance between another portion of the protector and the recording medium supporting section with regard to a relative movement direction of the recording medium and the light irradiating device.

14. The image recording apparatus of claim 11, wherein the protector is provided on the light irradiating device.

15. The image recording apparatus of claim 11, wherein the protector is detachably provided on the light irradiating device.

16. The image recording apparatus of claim 11, wherein the light irradiating device includes a housing, an irradiating aperture formed by the housing and a silica glass provided on the aperture.

17. The image recording apparatus of claim 11, wherein the protector includes a partition element and a plurality of slits made by the partition element.

18. The image recording apparatus of claim 11, wherein the photo irradiation is ultraviolet rays irradiation.

19. An image recording apparatus, comprising:

a recording medium supporting section which supports a recording medium;

a recording head which discharges a photo curable ink that is cured by photo irradiation;

a light irradiating device which irradiates the photo irradiation to the photo curable ink on the recording medium, and includes a light source;

a protector which is provided between the recording medium supporting section and the light irradiating device at the time of an image recording operation, wherein the protector includes a partition element and a plurality of slits made by the partition element; and a moving section which relatively moves at least one of the recording medium and the light irradiating device, wherein the photo irradiation is ultraviolet rays irradiation, and a first distance is longer than a second distance, the first distance is a distance between a portion of the protector and the recording medium supporting section, the second distance is a distance between another portion of the protector and the recording medium supporting section with regard to a relative movement direction of the recording medium and the light irradiating device.

20. The image recording apparatus of claim 19, wherein the protector is formed in a reticular pattern.

21. The image recording apparatus of claim 19, wherein the protector is provided on the light irradiating device.

22. The image recording apparatus of claim 19, wherein the protector is detachably provided on the light irradiating device.

23. The image recording apparatus of claim 19, wherein the image recording apparatus satisfies the following inequality, $$0.7 \leqq A/B < 1.0$$

where A represents a first cumulative illumination intensity in case the first cumulative illumination intensity through the protector is measured on the recording medium supporting section, and B represents a second cumulative illumination intensity without the protector is measured on the recording medium supporting section.

24. The image recording apparatus of claim 19, wherein the partition element includes a first surface and a second surface, the first surface is in a side where the recording head is located, and the second surface is in an opposite side to the first surface, a reflectance for the ultraviolet rays irradiation of the first surface is smaller than the that of the second surface.

25. The image recording apparatus of claim 19, wherein the partition element includes a surface, the surface is in a side where the recording head is located, a reflectance for the ultraviolet rays irradiation of the surface is not more than 50%.

26. The image recording apparatus of claim 19, wherein the partition element includes a surface, the surface is in an opposite side to where the recording head is located, a reflectance for the ultraviolet rays irradiation of the surface is not less than 60%.

* * * * *